US007862883B2

(12) United States Patent
Kudo

(10) Patent No.: US 7,862,883 B2
(45) Date of Patent: Jan. 4, 2011

(54) INTERMEDIATE TRANSFER MEMBER, METHOD OF PRODUCING INTERMEDIATE TRANSFER MEMBER, AND IMAGE FORMING APPARATUS PROVIDED WITH INTERMEDIATE TRANSFER MEMBER

(75) Inventor: Ichiro Kudo, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 457 days.

(21) Appl. No.: 12/090,280

(22) PCT Filed: Oct. 10, 2006

(86) PCT No.: PCT/JP2006/320169

§ 371 (c)(1),
(2), (4) Date: Apr. 15, 2008

(87) PCT Pub. No.: WO2007/046260

PCT Pub. Date: Apr. 26, 2007

(65) Prior Publication Data

US 2009/0123198 A1 May 14, 2009

(30) Foreign Application Priority Data

Oct. 20, 2005 (JP) ..... 2005-305436

(51) Int. Cl.
*B41M 5/00* (2006.01)
*B44C 1/17* (2006.01)
*G03G 7/00* (2006.01)

(52) U.S. Cl. ..... 428/195.1; 428/201; 428/206; 428/210; 428/325; 428/688

(58) Field of Classification Search ..... 428/195.1, 428/201, 206, 210, 325, 688; 399/302
See application file for complete search history.

(56) References Cited

U.S. PATENT DOCUMENTS

| | | | | |
|---|---|---|---|---|
| 5,922,440 | A * | 7/1999 | Schlueter et al. | 428/195.1 |
| 5,985,419 | A * | 11/1999 | Schlueter et al. | 428/195.1 |
| 7,754,313 | B2 * | 7/2010 | Hori et al. | 428/201 |
| 7,773,927 | B2 * | 8/2010 | Maehara | 399/302 |
| 2004/0265016 | A1 * | 12/2004 | Kitani et al. | 399/298 |
| 2008/0267675 | A1 * | 10/2008 | Maehara | 399/308 |
| 2009/0041514 | A1 * | 2/2009 | Maehara | 399/308 |
| 2009/0060598 | A1 * | 3/2009 | Kondo et al. | 399/297 |
| 2009/0123198 | A1 * | 5/2009 | Kudo | 399/308 |
| 2010/0098466 | A1 * | 4/2010 | Maehara et al. | 399/308 |

FOREIGN PATENT DOCUMENTS

| | | |
|---|---|---|
| JP | 9212004 | 8/1997 |
| JP | 11133205 | 5/1999 |
| JP | 2005274952 | 10/2005 |
| JP | 2006259581 | 9/2006 |

* cited by examiner

*Primary Examiner*—Betelhem Shewareged
(74) *Attorney, Agent, or Firm*—Lucas & Mercanti, LLP

(57) ABSTRACT

The present invention provides an intermediate transfer member having higher transferability and higher cleaning properties aid durability, an apparatus for producing an intermediate transfer member which does not require the provision of any large equipment such as vacuum equipment, and an image forming apparatus comprising the intermediate transfer member. The intermediate transfer member contains a support and, provided on the support, a first inorganic compound layer containing carbon atoms and a second inorganic compound layer as a surface layer, the second inorganic compound layer not containing any carbon atom or containing carbon atoms in a smaller amount than the carbon atoms in the first inorganic compound layer.

9 Claims, 4 Drawing Sheets

INTERMEDIATE TRANSFER MEMBER, METHOD OF PRODUCING INTERMEDIATE TRANSFER MEMBER, AND IMAGE FORMING APPARATUS PROVIDED WITH INTERMEDIATE TRANSFER MEMBER

This is a U.S. National Phase Application under 35 U.S.C. 371 of International Application PCT/JP2006/320169 filed on Oct. 10, 2006.

This Application claims the priority of Japanese Application No. 2005-305436, filed Oct. 20, 2005, the entire content of which is hereby incorporated by reference.

TECHNICAL FIELD

The present invention relates to an intermediate transfer member which is used to compose toner images of each color to form a color image and to transfer the image to a recording medium used in electrophotographic apparatuses or electrostatic recording apparatuses such as electrophotographic copiers, laser beam printers, or facsimile machines, as well as relates to an image forming apparatus provided with the intermediate transfer member.

BACKGROUND

Conventionally, as a method of transferring a toner image carried on an electrophotographic photoreceptor (hereinafter also referred to simply as a photoreceptor) to a recording material, an image forming method employing an intermediate transfer member has been known. In such a method, a final image is formed as follows: in a process in which a toner image is transferred from an electrophotographic photoreceptor to a recording material, another transfer process is provided wherein a toner image is primarily transferred from an electrophotographic photoreceptor to an intermediate transfer member and then the primary transferred image carried on the intermediate transfer member is secondarily transferred to a recording material. This method is often employed as a multiple transfer method for each color toner image in a so-called full color image forming apparatus which reproduces a color-separated original image via subtractive color mixing using such as a black toner, a cyan toner, a magenta toner, and a yellow toner.

However, in such a multiple transfer method employing the intermediate transfer member, image defects tend to occur due to the transfer failure of an toner image, since two processes, namely, the primary and the secondary transfer process, are carried out and also toners of four colors are superimposed on the transfer member.

It is generally known that transfer efficiency can be enhanced via surface treatment of a toner with an external additive such as silica against toner transfer failure. However, there are noted problems in that no adequate transfer efficiency is realized since silica is liable to be released from the toner surface and also to be buried into the interior of the toner due to the stress from a stirring member for the toner in the development device; the stress from a regulation blade to form a toner layer on the development roller; or the stress caused between the photoreceptor and the development roller. Therefore, a cleaning device is needed to scrape a toner remaining on the intermediate transfer member using a blade.

To overcome such problems, methods of forming a releasing layer on the surface of the intermediate transfer member have been proposed as described below. To enhance releasability of a toner from the intermediate transfer member, a silicon oxide layer or an aluminum oxide layer is formed on the intermediate transfer member (refer to Patent Document 1).

Further, a method of forming an inorganic coating layer on the intermediate transfer member has been proposed (refer to Patent Document 2).

Patent Document 1: Unexamined Japanese Patent Application Publication (hereinafter referred to as JP-A) No. 9-212004

Patent Document 2: JP-A No. 2000-206801

DISCLOSURE OF THE INVENTION

Problems to be Solved by the Invention

However, durability tests conducted on an intermediate transfer member prepared via a method based on Patent Document 1 using an actual image forming apparatus revealed problems in that an oxide layer peeled off from the surface layer due to repetitive flexing movements; and a large-scale apparatus such as a vacuum apparatus to form a silicon oxide layer via deposition or an aluminum oxide layer via sputtering was required.

Further, via a method based on Patent Document 2, it is understood that toner releasability is enhanced and then transfer efficiency thereof is improved by increasing an amount of colloidal silica added to an inorganic coating layer. However, since the inorganic layer tends to be cracked due to repetitive flexing movements in a durability test an amount more than a certain amount thereof cannot be added. Therefore, there have been problems in that the releasability is not realized adequately and the transfer efficiency is not increased to a level more than a certain level, either.

In view of the above problems, a first object of the present invention is to provide an intermediate transfer member exhibiting further enhanced transferability, as well as further enhanced cleaning properties and durability. A second object of the present invention is to provide a production apparatus of the intermediate transfer member requiring no large-scale apparatus such as a vacuum apparatus, and to provide an image forming apparatus provided with the intermediate transfer member.

Means to Solve the Problems

The above objects of the present invention can be achieved via the following constitutions.

(1) An intermediate transfer member comprising a support having thereon a first Inorganic compound layer comprising carbon atoms and, as a surface layer, a second inorganic compound layer containing no carbon atoms or containing carbon atoms of which carbon content is less than a carbon content in the first inorganic compound layer.

(2) The intermediate transfer member of Item (1), wherein the carbon content in the first inorganic compound layer is 0.1% by atom to 50% by atom (based on an XPS measurement).

(3) The intermediate transfer member of Item (1) or (2), wherein the carbon content in the second inorganic compound layer is 20% by atom or less (based on an XPS measurement).

(4) The intermediate transfer member of any one of Items (1) to (3), wherein the first inorganic compound layer or the second inorganic compound layer comprises a compound comprising at least one element selected from Si, Ti, Al, Zr, and Zn.

(5) The intermediate transfer member of any one of Items (1) to (3), wherein the first inorganic compound layer and the second inorganic compound layer each comprise a compound comprising at least one element selected from Si, Ti, Al, Zr, and Zn.

(6) The intermediate transfer member of any one of Items (1) to (5), wherein the first inorganic compound layer or the second inorganic compound layer is an inorganic oxide layer.

(7) The intermediate transfer member of any one of Items (1) to (5), wherein the first inorganic compound layer and the second inorganic compound layer each are an inorganic oxide layer.

(8) A method of producing the intermediate transfer member of any one of Items (1) to (7), wherein at least one of the first inorganic compound layer and, the second inorganic compound layer is formed, via an atmospheric pressure plasma CVD method.

(9) An image forming apparatus provided with an intermediate transfer member which further transfers a toner image transferred from a surface of an image carrier to a recording medium, wherein the intermediate transfer member is the intermediate transfer member of any one of Items (1) to (7).

Effects of the Invention

Based on the present invention, an intermediate transfer member can be provided, the intermediate transfer member exhibiting excellent toner releasability, enhanced transfer efficiency, and being free from peel-off of a compound layer from the surface of the support or cracks of the layer in heavy use, by providing a first inorganic compound layer on the surface of the support and further by forming, thereon, a second inorganic compound layer containing no carbon atoms or containing carbon atoms whose content is less than that in the first inorganic compound layer. Further, the production of the intermediate transfer member of the present invention via, an atmospheric pressure plasma CVD method makes it possible to result in realizing a production apparatus which produces an intermediate transfer member exhibiting the above effects without using any large-scale apparatus such as a vacuum apparatus. Still further, using an image forming apparatus employing the intermediate transfer member of the present invention, a high quality image with no image defects can be formed.

BRIEF DESCRIPTION OF THE DRAWINGS

FIG. 6(*b*) is a schematic view showing one example of a roll electrode.

FIG. 7(*b*) is a schematic view showing one example of a fixed electrode.

DESCRIPTION OF THE REFERENCE NUMBERS

Figure 1:
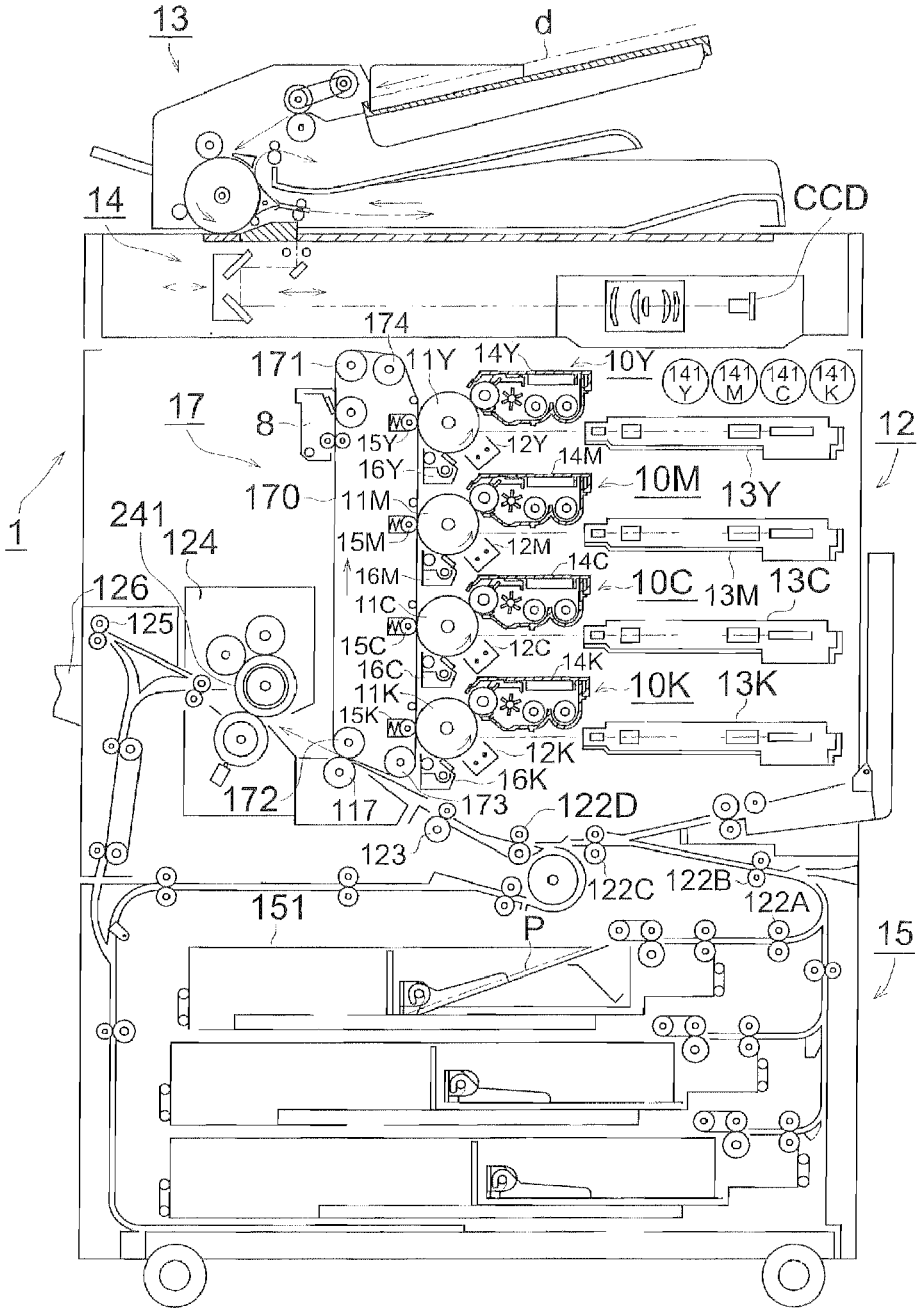
FIG. 1 is a cross-sectional constitution view showing one example of a color image forming apparatus.

1 color image forming apparatus
2 intermediate transfer member production apparatus
3 atmospheric pressure plasma CVD apparatus
17 intermediate transfer member unit
20 roll electrode
21 fixed electrode
23 discharge space
24 mixed gas supply unit
25 first power supply
26 second power supply
117 secondary transfer roller
170 intermediate transfer belt
175 support
176 first inorganic compound layer
177 second inorganic compound layer
177 driven roller

BEST MODE TO CARRY OUT THE INVENTION

The best mode to carry out the present invention will now be described that by no means limits the scope of the present invention.

The intermediate transfer member of the present invention is preferably usable for use in image forming apparatuses such as copiers, printers, or facsimile machines employing an electrophotographic method. The intermediate transfer member is usable as for as it allows a toner image carried on the surface of a photoreceptor to be primarily transferred to the intermediate transfer member; retains the transferred toner image thereon; and allows the retained toner image to be secondarily transferred to the surface of a transfer material such as recording paper. The intermediate transfer member may be either a belt-type transfer member or a drum-type transfer member.

Initially, an image forming apparatus incorporating the intermediate transfer member of the present invention will now be described with reference to a tandem color image forming apparatus as an example.

FIG. 1 is a cross-sectional constitution view showing one example of a full color image forming apparatus.

Color image forming apparatus 1 is referred to as a tandem full color image forming apparatus which contains automatic document feeder 13; document image reader 14; a plurality of exposure members 13Y, 13M, 13C, and 13K; a plurality of combinations of image forming sections 10Y, 10M, 10C, and 10K; intermediate transfer member unit 17; paper feeding member 15; and fixing member 124.

Automatic document feeder 13 and document image reader 14 are arranged on main body 12 of color image forming apparatus 1. The image of original document d, conveyed by automatic document feeder 13, is reflected and image-formed via the optical system of document image reader 14, and then read by a line image sensor CCD.

Analog signals, photo-converted from the original image having been read by the line image sensor CCD, are subjected to analog processing, A/D conversion, shading correction, and image compression processing in the image processing section (not shown) and transferred to exposure members 13Y, 13M, 13C, and 13K as digital image data for the individual colors. Thereafter, latent images of the image data of the individual colors are formed on drum-type photoreceptors (hereinafter also referred to as photoreceptors) 11Y, 11M, 11C, and 11K as first image carriers via corresponding exposure members 13Y, 3M, 13C, and 13K.

Image forming sections 10Y, 10M, 10C, and 10K are vertically aligned, and also on the left side of photoreceptors 11Y, 11M, 11C, and 11K, as shown, intermediate transfer member 170 of the present invention, which is a semiconductive and endless belt-type, is arranged as a second image carrier which is stretched around rollers 171, 172, 173, and 174 in a rotatable manner.

Then, intermediate transfer member 170 of the present invention is driven in the arrow direction via roller 171 rotationally driven by a drive device (not shown).

Image forming section 10Y, forming a yellow image, incorporates charging member 12Y, exposure member 13Y, developing member 14Y, primary transfer roller 15Y as a primary transfer member, and cleaning member 16Y, all of which are arranged around photoreceptor 11Y.

Image forming section 10M, forming a magenta image, incorporates photoreceptor 11M, charging member 12M, exposure member 13M, developing member 14M, primary transfer roller 15M as a primary transfer member, and cleaning member 16M.

Image forming section 10C, forming a cyan image, incorporates photoreceptor 11C, charging member 12C, exposure member 13C, developing member 14C, primary transfer roller 15C as a primary transfer member, and cleaning member 16C.

Image forming section 10K, forming a, black image, incorporates photoreceptor 11K, charging member 12K, exposure member 13K, developing member 14K, primary transfer roller 15K as a primary transfer member, and cleaning member 16K.

Toner feeding members 141Y, 141M, 141C, and 141K feed fresh toners into developing devices 14Y, 14M, 14C, and 14K, respectively.

Herein, primary transfer rollers 15Y, 15M, 15C, and 15K are selectively operated by controlling members (not shown) according to image types, and push intermediate transfer member 170 toward each of corresponding photoreceptors 11Y, 11M, 11C, and 11K to transfer the images on the photoreceptors.

Thus, the images of the individual colors, having been formed on photoreceptors 11Y, 11M, 11C, and 11K via image forming sections 10Y, 10M, 10C, and 10K, are sequentially transferred to rotating intermediate transfer member 170 by primary transfer roller 15Y, 15M, 15C, and 15K to form a composed color image.

Namely, the toner images carried on the surface of photoreceptors 11Y, 11M, 11C, and 11K are primarily transferred to the surface of intermediate transfer member 170, which retains the individually transferred toner images.

Further, recording paper P, serving as a recording medium, stored in feeding cassette 151, is fed by paper feeding member 15, and conveyed to secondary transfer roller 117, serving as a secondary transfer member, through a plurality of intermediate rollers 122A, 122B, 122C, and 122D, as well as registration roller 123. Then, the composed toner image on intermediate transfer member 170 is transferred to recording paper P at a time by secondary transfer roller 117.

Namely, the toner image, having been retained on intermediate transfer member 170, is secondarily transferred to the surface of a transferred material.

Herein, secondary transfer roller 117 serving as the secondary transfer member, only when recording paper P passes therethrough for the secondary transfer, allows recording paper P to be pressure-contacted to intermediate transfer member 170.

Recording paper P, on which the color image has been formed is fixed by fixing device 124, and clamped by paper discharge roller 125, followed by being placed on paper discharge tray 126 located outside the apparatus in contrast, after the color image has been transferred by secondary transfer roller 117 to recording paper P, the remaining toner on intermediate transfer member 170, from which recording paper P has been curvature-separated, is removed by cleaning member 8.

Herein, intermediate transfer member 170 may be replaced with a rotating drum-type intermediate transfer drum as described above.

Then, the structures of primary transfer rollers 15Y, 15M, 15C, and 15K serving as the primary transfer members contacting intermediate transfer roller 170, as well as of secondary transfer roller 117 will now be described.

Primary transfer rollers 15Y, 15M, 15C, and 15K are formed, for example, by coating the surrounding surface of a conductive core metal such as stainless steel of an 8 mm outer diameter with a semiconductive and elastic rubber of a 5 mm thickness and a rubber hardness of about 20°-about 70° (based on the Asker C hardness) in the solid or sponge form featuring a volume resistance of about $10^5$ Ω·cm-about $10^9$ Ω·cm, which is prepared by dispersing a conductive filler such as carbon or by incorporating an ionic conductive material in a rubber material such as polyurethane, EPDM, or silicone.

Secondary transfer roller 117 is formed by coating the surrounding surface of a conductive core metal such as stainless steel of an 8 mm outer diameter with a semiconductive and elastic rubber of a 5 mm thickness and a rubber hardness of about 20°-about 70° (based on the Asker C hardness) in the solid or sponge form featuring a volume resistance of about $10^5$ Ω·cm-about $10^9$ Ω·cm, which is prepared by dispersing a conductive filler such as carbon or by incorporating an ionic conductive material in a rubber material such as polyurethane, EPDM, or silicone.

Since secondary transfer roller 117, differently from primary transfer rollers 15Y, 15M, 15C, and 15K, may be in contact with a toner when no recording paper P exists, a highly releasable material such as a semiconductive fluorine resin or urethane resin is preferably coated on the surface of secondary transfer roller 117. Therefore, secondary transfer roller 117 is formed by coating the surrounding surface of a conductive core metal such as stainless steel with a semiconductive material of a thickness of about 0.05 mm-about 0.5 mm which is prepared by dispersing a conductive filler such as carbon or by incorporating an ionic conductive material in a rubber or resin material such as polyurethane, EPDM, or silicone.

The intermediate transfer member of the present invention will now be described with reference to intermediate transfer member 170.

Figure 2:
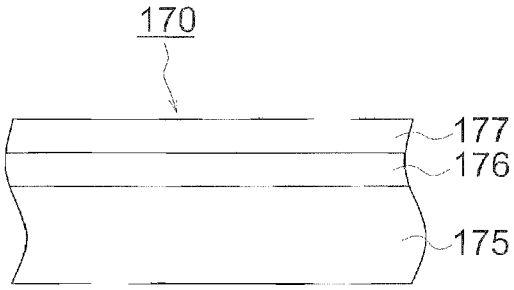
FIG. 2 is a conceptual cross-sectional view showing a layer structure of an intermediate transfer member.

A cross-sectional view of intermediate transfer member 170 of the present invention is shown in FIG. 2.

Intermediate transfer member 170 of the present invention is structured in such a manner that first inorganic compound layer 176 is arranged on the surface of support 175, and then second inorganic compound layer 177 is arranged on the surface of the first one in this sequential order, wherein second inorganic compound layer 177 contains no carbon atoms or containing carbon atoms whose content is less than that in first inorganic compound layer 176. Such a structure makes it possible to realize intermediate transfer member 170 exhibiting excellent toner releasability and enhanced transfer efficiency, as well as handling long time use even in repetitive heavy use. It is conceivable that, by allowing second inorganic compound layer 177, being the toner-transferring surface, to contain no carbon atoms or containing a smaller amount thereof, high releasability can be maintained, and also by allowing first inorganic compound layer 176 to contain a larger amount of carbon atoms than that in second inorganic compound layer 177, adhesion between support 175 and first inorganic compound layer 176 can be maintained, whereby cracks or peel-off tends not to occur even during repetitive flexing movements.

Further, the carbon content in second inorganic compound layer 177 measured via an XPS method is preferably at most 20% by atom to realize intermediate transfer member 170 exhibiting further excellent releasability. Still further, the carbon content in second inorganic compound layer 176 measured via the XPS method is preferably from 0.1% by atom-50% by atom to realize intermediate transfer member 170 exhibiting further excellent durability.

Constituent elements of intermediate transfer member 170 of the present invention will now be described.

(Support)

As support 175 for intermediate transfer member 170 of the present invention, there can be used appropriate members, formed on the circumference of a belt or drum, which are prepared by dispersing conductive agents in resin materials or elastic materials. These members may be used individually or in combination, and any appropriate belts, which are prepared in combinations of laminates of these resin materials or elastic materials, may also be used.

As the resin materials, employable are so-called engineering plastic materials such as polycarbonates, polyimides, polyether ether ketones, polyvinylidene fluorides, ethylene-tetrafluoroethylene copolymers, polyamides, polyamideimides, or polyphenylene sulfides.

As the elastic materials, employable are rubber materials such as isoprene rubber, butadiene rubber, styrene-butadiene rubber, acrylonitrile-butadiene rubber, nitrile rubber, hydrorubber, fluorine rubber, silicone rubber, ethylene-propylene rubber, chloroprene rubber, acryl rubber, butyl rubber, urethane rubber, chlorosulfonated polyethylene rubber, epichlorohydrin rubber, natural rubber, or polyether rubber, as well as elastomers such as polyurethane, polystyrene-polybutadiene block polymers, polyolefins, polyethylene, chlorinated polyethylene, or ethylene-vinyl acetate copolymers. To reduce hardness, an elastic material layer may be a formed substance, and in this case, the density thereof is preferably from 0.1 $g/cm^3$-0.9 $g/cm^3$.

Further, as the conductive agents, carbon blacks are employable Any carbon black may be used with no specific limitation, and neutral carbon black may be used. It is only necessary that the amount of the conductive agent used be added in such a manner that the volume resistance value and the surface resistance value of intermediate transfer member 170 fall within a predetermined range, depending on the type of the conductive agent used. Four-40 parts of the conductive agent, based on 100 parts of the resin material, is commonly added Support 175 used in the present invention may be produced via common methods conventionally known in the art. For example, the support can be produced in such a manner that a resin to be used for the material is melted with an extruder, and then rapidly cooled via extrusion through an annular die or a T die.

(The First Inorganic Compound Layer and the Second Inorganic Compound Layer)

Subsequently, first inorganic compound layer 176 and second inorganic compound layer 177 of the present invention are formed on thus-prepared support 175.

Examples of an inorganic compounds used for first inorganic compound layer 176 and second inorganic compound layer 177 of the present invention include inorganic oxide, inorganic nitride, inorganic carbide, and a composite material thereof.

Examples of inorganic compounds used for first inorganic compound layer 176 and/or second inorganic compound layer 177 of the present invention include silicon oxide, aluminum oxide, tantalum oxide, titanium oxide, zirconium oxide, tin oxide, zinc oxide, iron oxide, vanadium oxide, beryllium oxide, barium strontium titanate, barium zirconate titanate, lead zirconate titanate, lead lanthanum titanate, strontium titanate, barium titanate, bismuth titanate, strontium bismuth titanate, strontium bismuth tantalate, bismuth tantalate niobate, and yttrium trioxide. Of these, more preferable are silicon oxide, aluminum oxide, titanium oxide, zinc oxide, and zirconium oxide.

A material used for first inorganic compound layer 176 and a material used for second inorganic compound layer 177 in the present invention may be the same or different. Further, the material used for first inorganic compound layer 176 or the material used for second inorganic compound layer 177 in the present invention may be an inorganic compound of one type or may contain at least two types of compounds.

Prior to formation of first inorganic compound layer 176 of the present invention on support 175, surface treatment such as corona treatment, flame treatment, plasma treatment, glow discharge treatment, surface roughening treatment, or chemical treatment may be conducted.

Further, anchor coating agent layers may be formed between first inorganic compound layer 176 and support 175 in the present invention, as well, as between first inorganic compound layer 176 and second inorganic compound layer 177 in the present invention in order to enhance adhesion therebetween. Anchor coating agents used for the anchor coating agent layers include polyester resins, isocyanate resins, urethane resins, acryl resins, ethylene-vinyl alcohol resins, vinyl modified resins, epoxy resins, modified styrene resins, modified silicon resins, or alkyl titanates, any of which may be used individually or in combination. Appropriate additives conventionally known in the art may optionally be added to these anchor coating agents. An anchor coating agent, described above, is coated on the support via a method known in the art such as roll coating, gravure coating, knife coating, dip coating, or spray coating, followed by drying and removal of a solvent and a diluting agent to complete anchor-coating. The amount of the anchor coating agent coated is preferably from about 0.0001 $g/m^2$-about 5 $g/m^2$ (in the dried form).

The thickness of first inorganic compound layer 176 of the present invention is appropriately from 1 nm-5000 nm and preferably from 3 nm-3000 nm. The thickness of second inorganic compound layer 177 is appropriately from 1 nm-5000 nm, preferably from 3 nm-3000 nm. In cases in which the thickness of first inorganic compound layer 176 is less than 1 nm or exceeds 5000 nm, cracks or peel-off tends to occur in repetitive use. Further, in cases in which the thickness of second inorganic compound layer 177 is less than 1 nm, abrasion tends to occur and continuousness of toner releasability or transfer efficiency may become insufficient, and when exceeding 5000 mm, layer cracks or peel-off tends to occur in repetitive use.

The carbon content in second inorganic compound layer 177 of the present invention is preferably less than that in first inorganic compound layer 176. The carbon content in second inorganic compound layer 177 is preferably smaller from the viewpoint of toner releasability and transfer efficiency. However, in a structure where an inorganic compound layer containing a smaller amount of carbon is formed on the surface of support 175, a problem of peel-off or cracks of the inorganic compound layer has been observed in repetitive use. Accordingly, intermediate transfer member 170, which is free from cracks or peel-off even in repetitive use and durable a long time, has been realized in such a manner that first inorganic compound layer 176 containing a larger amount of carbon atoms than that in second inorganic compound layer 177 is formed between support 175 and second inorganic compound layer 177 containing no carbon atoms or carbon atoms of a smaller amount. It is conceivable that First inorganic compound layer 176 functions to enhance adhesion between support 175 and second inorganic compound layer 177, as well as to reduce bending stress applied to second inorganic compound layer 177 and to prevent abrasions.

Further, the carbon content in first inorganic compound layer 176, measured via an XPS method, is preferably from 0.1% by atom-50% by atom.

Still further, the carbon content in second inorganic compound layer 177, measured via the XPS method, is preferably 20% by atom or less.

Formation methods of first inorganic compound layer 176 and second inorganic compound layer 177 of the present invention will now be described.

The formation methods of first inorganic compound layer 176 and, second inorganic compound layer 177 of the present invention include a dry process such as a vacuum evaporation method, a molecular beam epitaxy method, an ion cluster beam method, a low-energy ion beam method, an ion plating method, a CVD method, a sputtering method, an atmospheric pressure plasma CVD method, as well as a wet process including a coating method such as a spray coating method, a, spin coating method, a blade coating method, a dip coating method, a casting method, a roll coating method, a bar coating method, or a die coating method, and a patterning method such as common printing or ink-jet printing, any of which may be employed depending on materials to be used. As the wet process, there is used a method wherein a liquid prepared by dispersing inorganic compound fine particles in any appropriate organic solvent or water, if necessary, using a dispersing aid such as a surfactant, is coated and then dried; or a so-called sol-gel method wherein a solution of an oxide precursor such as an alkoxide is coated and then dried of these described above, an atmospheric pressure plasma CVD method is preferable. The atmospheric pressure plasma CVD method is a film formation method which requires no decompression chamber and handles high speed film formation, featuring high productivity. Further, a film produced via the atmospheric pressure plasma CVD method exhibits uniformity and features a flat and smooth surface, and also a film with extremely small interior stress can readily be formed via the method.

Formation methods of first inorganic compound layer 176 and second inorganic compound layer 177 (for example, inorganic oxides: $SiO_2$, $TiO_2$) via a plasma CVD method at atmospheric pressure have been described as follows.

The plasma CVD method at atmospheric pressure refers to forming treatment of a thin film on a support, wherein a discharge gas is exited and discharged at atmospheric pressure or in the vicinity thereof, and at least either of a raw material gas and a reactive gas is introduced into a discharge space and then excited. This method (hereinafter also referred to as an atmospheric plasma method) is described, for example, in JP-A Nos. 11-133205, 2000-185362, 11-61406, 2000-147209, and 2000-121804. Herewith, a high performance thin film can be formed with high productivity, Herein, the vicinity of atmospheric pressure represents a pressure of 20 kPa-110 kPa, preferably from 93 kPa-104 kPa.

There will now be described apparatuses, methods, and gases used when forming inorganic compound layers for the intermediate transfer member of the present invention via the atmospheric pressure CVD.

Figure 3:
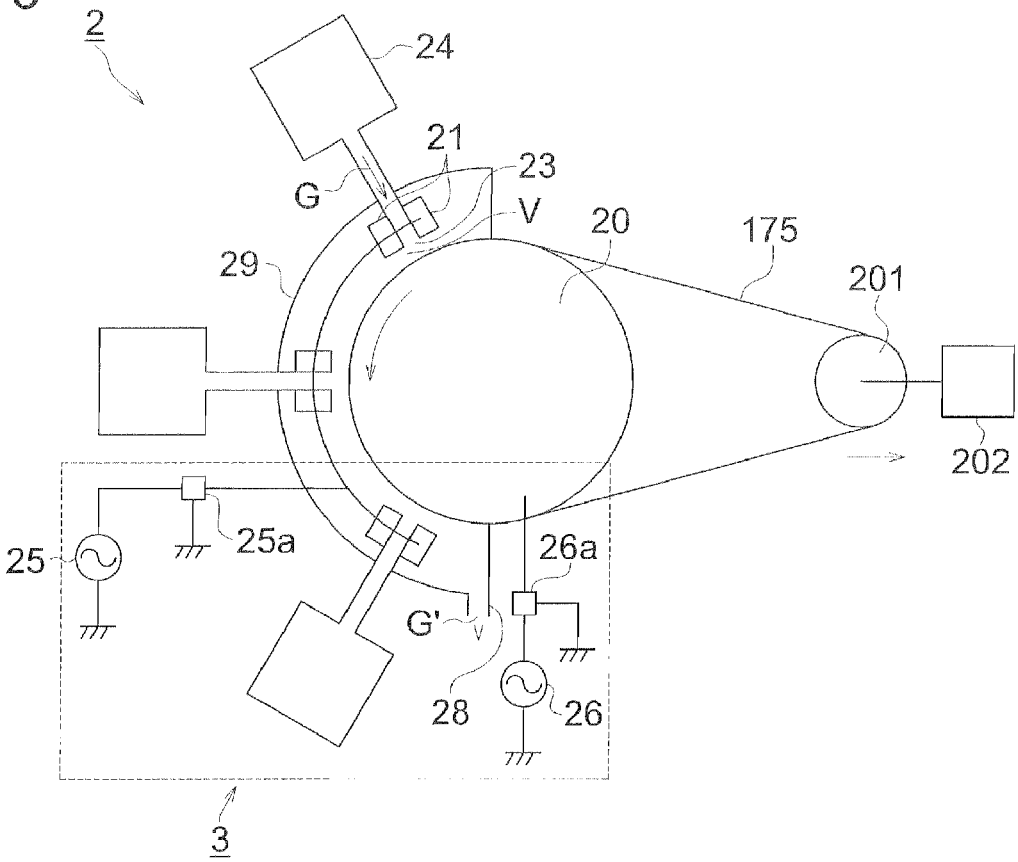
FIG. 3 is an explanatory view showing a first production apparatus producing an intermediate transfer member.

FIG. 3 is an explanatory view showing first production apparatus 2 producing the intermediate transfer member.

Production apparatus 2 (a direct method in which the discharge space and the thin film deposition area are almost the same) for the intermediate transfer member forms first inorganic compound layer 176 and second inorganic compound layer 177 on support 175, wherein the production apparatus is constituted of roll electrode 20 and driven roller 201 rotating in the arrow direction while winding-supporting support 175 for endless belt-type intermediate transfer member 170, as well as atmospheric plasma CVD apparatus 3 which is a film formation apparatus forming first inorganic compound layer 176 and second inorganic compound layer 177 on the surface of support 175.

Atmospheric plasma CVD apparatus 3 incorporates at least one set of fixed electrodes 21 aligned along the outer circumference of roll electrode 20; a facing area, which is also discharge space 23, between fixed electrodes 21 and roll electrode 20; mixed gas supply unit 24 producing mixed gas G of at least a raw material gas and a discharge gas and supplying mixed gas G into discharge space 23; discharge container 29 reducing air flow into discharge space 23; first power supply 26 connected to roll electrode 20; second power supply 25 connected to fixed electrodes 21; and exhaust section 28 exhausting exhaust gas G' having been already used.

Mixed gas supply unit 24 supplies discharge space 23 with a raw material gas, functioning to form a film structured of at least one layer selected from an inorganic oxide layer, an inorganic nitride layer, and an inorganic carbide layer; nitrogen gas or a rare gas such as argon gas or helium gas; and a gas which controls decomposition of the raw material gas.

Herein, the gas which controls decomposition of the raw material gas (or the raw material decomposition-controlling gas) represents a gas containing an element exhibiting activity in its molecular structure, including, for example, a gas containing an element such as H, O, N, S, F, B, Cl, P, Br, I, As, or Se. The gas containing an element exhibiting activity may be used individually or in combination. Further, the gas containing an element exhibiting activity may contain C in its molecular structure. Still further, the gas may be used by mixing a gas containing C in its molecular structure.

Further, driven roller 201 is pulled by tension providing member 202 in the arrow direction to apply a predetermined tension to support 175. The applied tension via tension providing member 202 is released during replacement of support 175 to enable easy replacement thereof.

First power supply 25 outputs a voltage at frequency $\omega 1$ and second power supply 26 outputs a voltage at frequency $\omega 2$. Then, via these voltages, electric field V is generated wherein frequencies $\omega 1$ and $\omega 2$ are superimposed in discharge space 23. Thus, layers (namely first inorganic compound layer 176 and second inorganic compound layer 177) are deposited on the surface of support 175 by plasmatizing the discharge gas via electric field V according to the raw material gas contained in mixed gas C.

Herein, the thicknesses of the inorganic compound layers may be adjucted in such a manner that the inorganic compound layers are deposited in a stacked state using a plurality of the fixed electrodes located on the downstream side of the rotative direction of the roll electrode among all of the fixed electrodes, as well as using mixed gas supply units.

Further, first inorganic compound layer 176 may be deposited using a plurality of the fixed electrodes located on the lowest downstream side of the rotative direction of the roll electrode among all of the fixed electrodesas as well as using the mixed gas supply unit, and then other layers such as an adhesive layer to enhance adhesion between first inorganic compound layer 176 and support 175 may be formed using other fixed electrodes and mixed gas supply units located on the upper stream side.

still further, in order to enhance adhesion between first inorganic compound layer 176 and support 175, plasma treatment may be conducted to activate the surface of support 175 by arranging a gas supply unit to supply a gas such as nitrigen, helium, argon, oxygen, or hydrogen, as well as by arranging fixed electrodes on the upstream side of the fixed electrodes and the mixed gas supply unit to form first inorganic compound layer 176.

As described above, an intermediate transfer member, which is an endless belt, is stretched by a pair of the rollers, wherein one of a pair of the rollers is assigned to be one of a pair of the electrodes. Along the circumference surface of the roller assigned to be one of a pair of the electrodes, at least one fixed electrode, which is another electrode, is placed. Then, plasma discharge is carried out by generating an electric field between a pair of these electrodes at atmospheric pressure or in the vicinity thereof. Thus, an inorganic compound thin layer is deposited and formed on the surface of the intermediate transfer member. With the above constitutions, second inorganic compound layer 177 is formed after formation of first inorganic compound layer 176, whereby the intermediate transfer member exhibiting high transferability, cleaning properties, and durability can be produced.

With regard to a formation method of first inorganic compound layer 176 and second inorganic compound layer 177, any formation method is not specifically limited as long as the method forms second inorganic compound layer 177 after formation of first inorganic compound layer 176 on support 175. After first inorganic compound layer 176 has been formed on the upstream side of the atmospheric pressure plasma CVD apparatus, second inorganic compound layer 177 may continuously be formed on the downstream side thereof. Such a continuous film formation method makes it possible to increase productivity, to enhance adhesion between first inorganic compound layer 176 and second inorganic compound layer 177, and to produce an intermediate transfer member exhibiting further durability.

Further, as another embodiment, it is possible to allow one electrode selected from the roll electrode and the fixed electrode to be connected to ground and the other electrode to be connected to a power supply. As the power supply in this case, a second power supply is preferably used from the viewpoint of high-density thin film formation, which is specifically preferable for cases in which a rare gas such as argon is used as a discharge gas.

Figure 4:
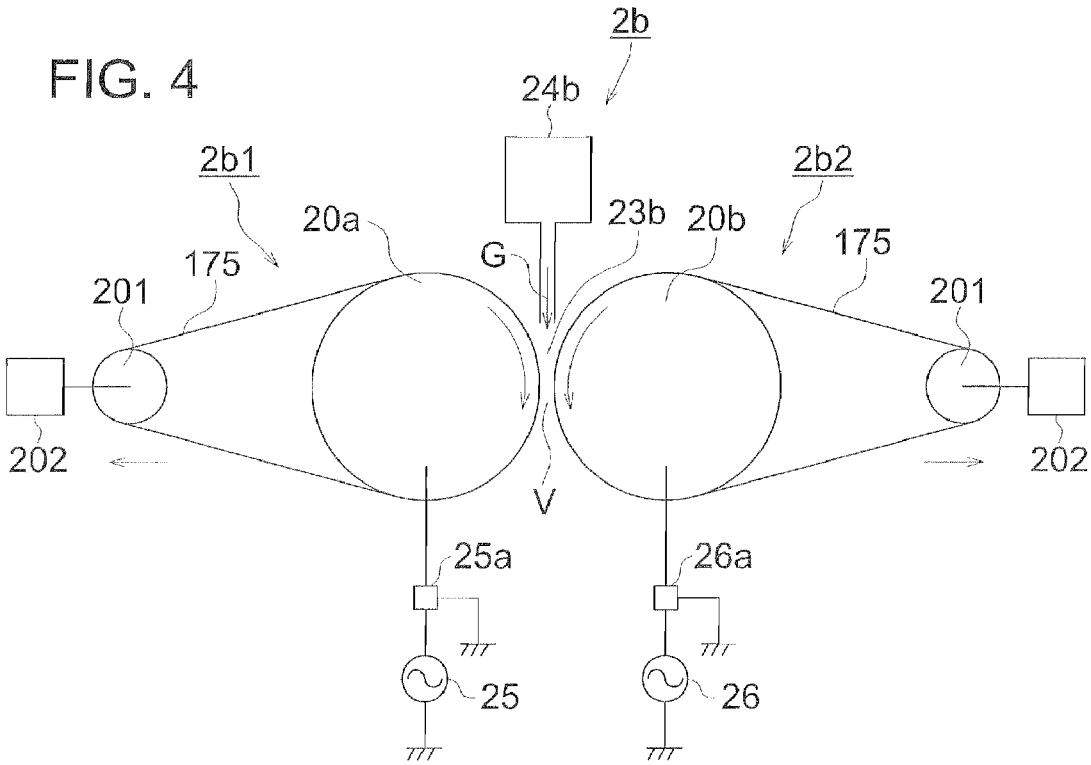
FIG. 4 is an explanatory view showing a second production apparatus producing an intermediate transfer member.

FIG. 4 is an explanatory view showing a second production apparatus producing the intermediate transfer member.

Second production apparatus 2*b* for the intermediate transfer member forms a first or second inorganic compound layer on a plurality of supports concurrently, being mainly constituted of a plurality of film formation apparatuses 2*b*1 and 2*b*2 which form an inorganic compound layer on the support surface.

Second production apparatus 2*b* (a modified direct type which carries out discharge and thin film deposition between opposed electrodes) incorporates first film formation apparatus 2*b*1; second film formation apparatus 2*b*2, which is arranged almost in mirror image relation with first film formation apparatus 2*b*1 with a predetermined space therebetween; mixed gas supply unit 24*b*, arranged between first film formation apparatus 2*b*1 and second film formation, apparatus 2*b*2, which generates mixed gas G of at least a raw material gas and a discharge gas and supplies mixed gas G to discharge space 23*b*.

First film formation apparatus 2*b*1 incorporates roll electrode 20*a* and driven roller 201 rotating in the arrow direction while winding-supporting support 175 for an endless belt-type intermediate transfer member; tension providing member 202 pulling driven roller 201 in the arrow direction; and first power supply 25 connected to roll electrode 20*a*. Second film formation apparatus 2*b*2 incorporates roll electrode 20*b* and driven roller 201 rotating in the arrow direction while winding-supporting support 175 for an endless belt-type intermediate transfer member; tension providing member 202 pulling driven roller 201 in the arrow direction; and second power supply 26 connected to roll electrode 20*b*.

Further, second production apparatus 2*b* incorporates discharge space 23*b* which is a facing area between roll electrode 20*a* and roll electrode 20*b* where discharge is carried out.

Mixed gas supply unit 24*b* supplies discharge space 23*b* with a raw material gas, functioning to form a film structured of at least one layer selected from an inorganic oxide layer, an inorganic nitride layer, and an inorganic carbide layer; nitrogen gas or a rare gas such as argon gas or helium gas; and a gas which controls decomposition of the raw material gas.

First power supply 25 outputs a voltage at frequency ω1 and second power supply 26 outputs a voltage at frequency ω2. Then, via these voltages, electric field V is generated wherein frequencies ω1 and ω2 are superimposed in discharge space 23. Thus, mixed gas G is plasmatized (excited) by electric field V, and the surfaces of support 175 in first film formation apparatus 2*b*1 and of support 175 in second film formation apparatus 2*b*2 are exposed to the plasmatized (excited) mixed gas. Then, layers (inorganic compound layers) are concurrently deposited and formed on the surfaces of support 175 in first film formation apparatus 2*b*1 and of support 175 in second film formation apparatus 2*b*2 according to the raw material gas contained in plasmatized (excited) mixed gas G.

Herein, roll electrode 20*a* and roll electrode 20*b*, facing each other, are arranged with a predetermined space therebetween.

Further, as another embodiment, it is possible to allow one roll electrode selected from roll electrode 20*a* and roll electrode 20*b* to be connected to ground and the other roll electrode to be connected to a power supply. As the power supply in this case, a second power supply is preferably used from the viewpoint of high-density thin film formation, which is specifically preferable for cases in which nitrogen gas or a rare gas such as argon gas or helium gas is used as a discharge gas.

An embodiment of an atmospheric pressure plasma CVD apparatus forming an inorganic compound layer on support 175 will now be detailed.

Figure 5:
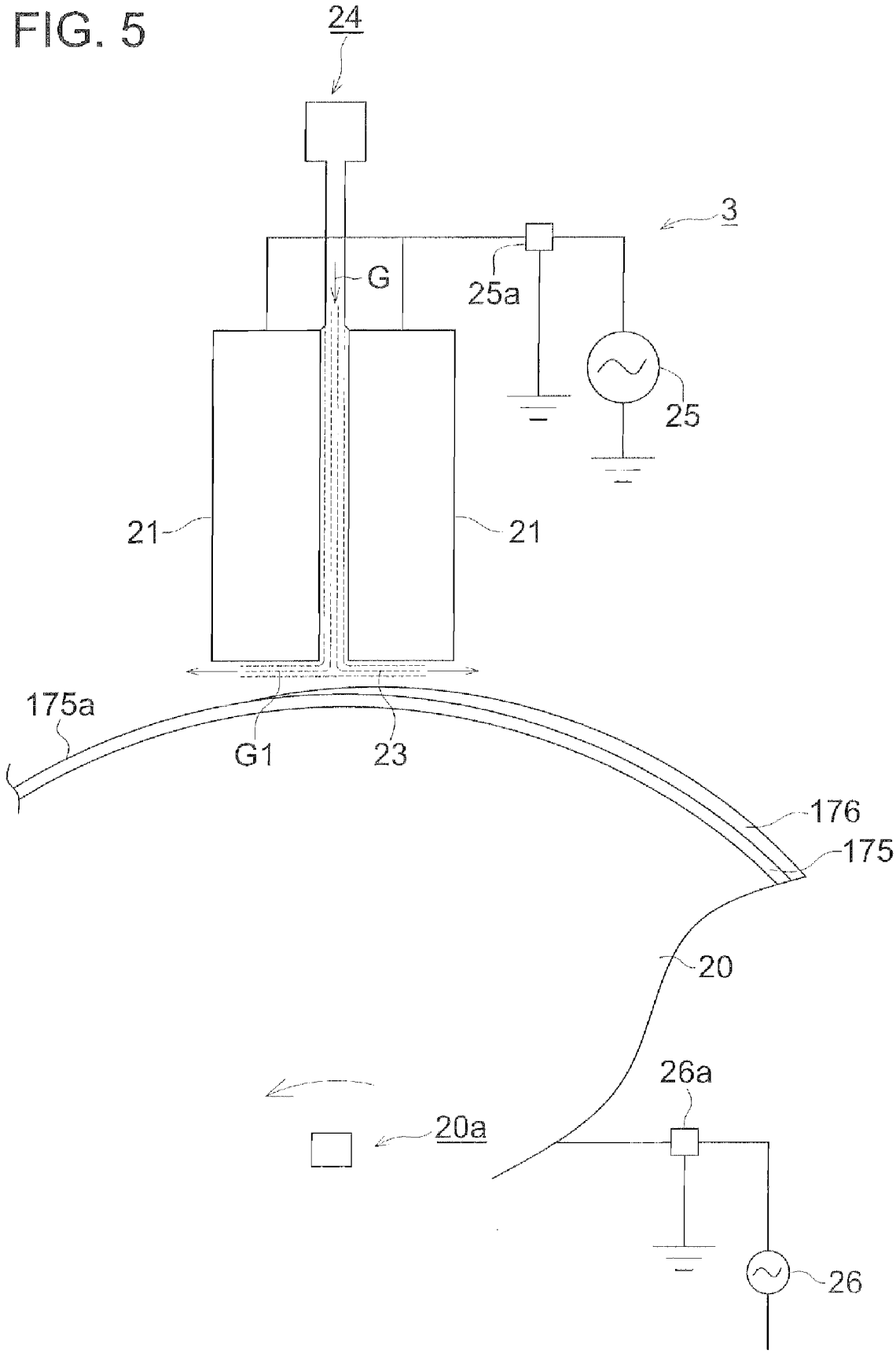
FIG. 5 is an explanatory view showing a first plasma film formation apparatus producing an intermediate transfer member via plasma.

Incidentally, FIG. 5, shown below, is a view prepared by extracting mainly the dashed line portion of first plasma film formation apparatus 2 shown in FIG. 3.

FIG. 5 is an explanatory view showing a first film formation apparatus producing an intermediate transfer member via plasma.

With reference to FIG. 5, one example of an atmospheric pressure plasma CVD apparatus preferably used to form first inorganic compound layer 176 will now be described.

Atmospheric pressure plasma CVD apparatus 3 is a production apparatus incorporating at least a pair of rollers which detachably winding-support and rotation-drive a support, and at least a pair of electrodes which conduct plasma discharge, wherein one electrode of a pair of the electrodes is one roller of a pair of the rollers; the other electrode is a fixed electrode facing, via the support, the former, which has been just described as one roller, which creates a facing area together with the fixed electrode; the support is exposed to plasma generated in the facing area; and then an intermediate transfer member is produced via deposition and formation of the inorganic compound layer. For example, when nitrogen is used as a discharge gas, the production apparatus is preferably used to stably initiate and continue discharge via application of a high voltage from one power supply and of a high frequency from the other power supply.

Atmospheric pressure plasma CVD apparatus 3 incorporates, as described above, mixed gas supply unit 24, fixed electrode 21, first power supply 25, first filter 25*a*, roll electrode 20, driving member 20*a* drive-rotating the roll electrode in the arrow direction, second power supply 26, and second filter 26*a*. The apparatus conducts plasma discharge in discharge space 23 to excite mixed gas G prepared by mixing a raw material gas containing an organic substance with a discharge gas; exposes the surface of support 175*a* to excited mixed gas G1; and then deposits and forms an inorganic compound layer containing carbon on the surface thereof.

Then, a first high frequency voltage of frequency $\omega_1$ is applied to fixed electrode 21 from first power supply 25 and a high frequency voltage of frequency $\omega_2$ is applied to roll electrode 20 from second power supply 26. Thereby, an electric field is generated between fixed electrode 21 and roll electrode 20, wherein electric field intensity $V_1$ and frequency $\omega_1$ are superimposed with electric field intensity $V_2$ and frequency $\omega_2$, and then current $I_1$ flows through fixed electrode 21 and current $I_2$ flows through roll electrode 22 to generate plasma between the electrodes.

Herein, the relation of frequency $\omega_1$ and frequency $\omega_2$ and the relation of electric field intensity $V_1$, electric field intensity $V_2$, and electric field intensity IV initiating discharge of a discharge gas satisfy the relation $V_1 \geqq IV > V_2$ or $V_1 > IV \geqq V_2$ when $\omega_1 < \omega_2$, wherein the output density of the above second high frequency electric field is at least 1 W/cm$^2$.

Since electric field intensity IV initiating discharge of nitrogen gas is 3.7 kV/mm, electric field intensity $V_1$ applied from first power supply 25 is preferably at least 3.7 kV/mm and electric field intensity $V_2$ applied from second power supply 26 is preferably at most 3.7 kV/mm.

Further, as first power supply 25 (a high frequency power supply) usable for first atmospheric pressure plasma CVD apparatus 3, any of the following products available on the market may be used:

| Applying power supply symbol | Manufacturer | Frequency | Product name |
|---|---|---|---|
| A1 | Sinko Electric Co., Ltd. | 3 kHz | SPG3-4500 |
| A2 | Sinko Electric Co., Ltd. | 5 kHz | SPG5-4500 |
| A3 | Kasuga Electric Works Ltd. | 15 kHz | AGI-023 |
| A4 | Sinko Electric Co., Ltd. | 50 kHz | SPG50-4500 |
| A5 | Haiden Laboratory Inc. | 100 kHz* | PHF-6k |
| A6 | Pearl Kogyo Co., Ltd. | 200 kHz | CF-2000-200k |
| A7 | Pearl Kogyo Co., Ltd. | 400 kHz | CF-2000-400k |

Sill further, as second power supply 26 (a high frequency power supply), any of the following products available on the market may be used:

| Applying power supply symbol | Manufacturer | Frequency | Product name |
|---|---|---|---|
| B1 | Pearl Kogyo Co., Ltd. | 800 kHz | CF-2000-800k |
| B2 | Pearl Kogyo Co., Ltd. | 2 MHz | CF-2000-2M |
| B3 | Pearl Kogyo Works Ltd. | 13.56 MHz | CF-5000-13M |
| B4 | Pearl Kogyo Co., Ltd. | 27 MHz | CF-2000-27M |
| B5 | Pearl Kogyo Co., Ltd. | 150 MHz | CF-2000-150M |

Herein, of the above power supplies, the asterisk (*) means an impulse high frequency power supply (100 kHz in a continuous mode) produced by Haiden Laboratory Inc. The other power supplies listed are high frequency power supplies capable of applying continuous sine waves only.

In the present invention, the power supplied between the opposed electrodes from the first and the second power supply is a power (an output density) of at least 1 W/cm$^2$ supplied to fixed electrode 21, whereby a discharge gas is excited to generate plasma and then to form a thin film. The upper limit of the power supplied to fixed electrode 21 is preferably 50 W/cm$^2$. The lower limit thereof is preferably 1.2 W/cm$^2$. Herein, the discharge area (cm$^2$) refers to an area where discharge occurs in an electrode.

It is also possible to increase the output density while uniformity of the high frequency electric field is maintained by supplying a power (an output density) of at least 1 W/cm$^2$ to roll electrode 20 as well. With this, further uniform high density plasma can be generated, resulting in compatibility of the further increase in film formation speed and in film quality. The power supplied to roll electrode 20 is preferably at least 2 W/cm$^2$, but the upper limit thereof is preferably 50 W/cm$^2$.

Herein, the waveform of the high frequency electric field is not specifically limited. There exist a continuous oscillation mode, called a continuous mode, with a continuous sine wave and an intermittent oscillation mode, called a pulse mode, performing on-off operations intermittently. Either of them may be employed. However, the continuous sine wave is preferable as a high frequency wave supplied at least to roll electrode 20 to produce a further high-density and high-quality film.

First filter 25*a* is placed between fixed electrode 21 and first power supply 25 to facilitate current flow from first power supply 25 to fixed electrode 21 and to restrict current flow from second power supply 26 to first power supply 25 by grounding the current from second power supply 26. Further, second filter 26*a* is placed between roll electrode 20 and second power supply 2 to facilitate current flow from second power supply 26 to roll electrode 20 and to restrict current flow from first newer supply 25 to second power supply 26 by grounding the current from first power supply 25.

As the electrodes, there are preferably employed electrodes which can apply a strong electric field and then can maintain a uniform and stable discharge state, as described above. The surface of at least either of fixed electrode 21 and roll electrode 20 is coated with a dielectric material described below so that the two electrodes may handle discharge generated by the strong electric field.

In the relation between the electrode and the power supply described above, it is possible to connect second power supply 26 to fixed electrode 21 and to connect first power supply 25 to roll electrode 20.

As another embodiment, it is also possible to connect one of fixed electrode 21 and roll electrode 20 to ground and to connect a power supply to the other electrode. As the power supply in this case, the second power supply is preferably used to carry out high-density thin film formation, which is specifically preferable for cases in which a rare gas such as argon is used as a discharge gas.

Figure 6:
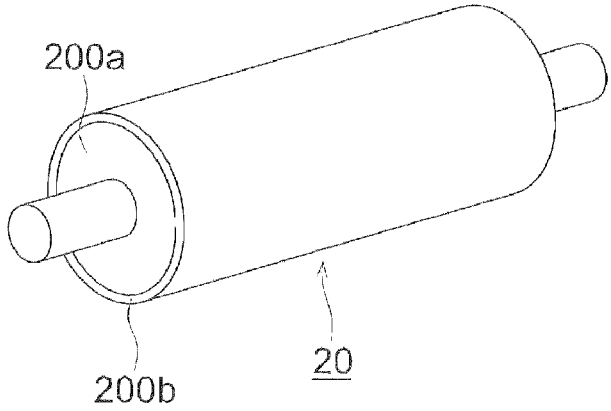
FIG. 6(*a*) is a schematic view showing one example of a roll electrode.
Figure 6:
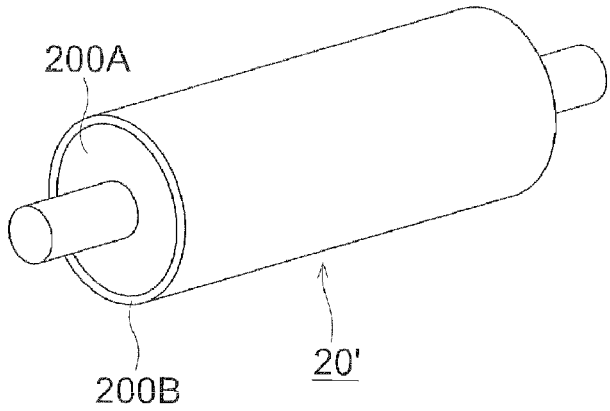

FIG. 6(*a*) and FIG. 6(*b*) each are a pair 20 schematic views showing one example of the roll electrode.

The structure of roll electrode 20 is described. In FIG. 6(*a*), roll electrode 20 is structured in such a manner that a ceramic material is sprayed on conductive base material 200*a* (hereinafter also referred to as "electrode base material") such as metal, and then ceramic-coated dielectric material 200*b* (hereinafter also referred to simply as "dielecric material"), sealing-treated with an inorganic material, is coated thereon. As the ceramic material for use in spraying, alumina or silicon nitride is preferably used, but of these, alumina is more preferably used due to its easy workability.

Further, as shown in FIG. 6(*b*), roll electrode 20' may be structured in such a manner that lining-treated dielectric material 200B, prepared via lining of an inorganic material, is coated on conductive base material 200A such as metal. As the lining material, there are preferably used silicate glass, borate glass, phosphate glass, germanate glass, tellurite glass, aluminate glass, or vanadate glass, but of these, borate glass is more preferably used due to its easy workability.

As conductive base materials 200*a* and 200A such as metal, metals such as silver, platinum, stainless steel, aluminum, or iron are cited, but of these, stainless steel is preferable from the viewpoint of workability.

Incidentally, in the embodiments of the present invention, as base materials 200*a* and 200A for the roll electrode, a stainless steel-made jacket roll base material having a cooling member using cooled water is used (not shown).

Figure 7:
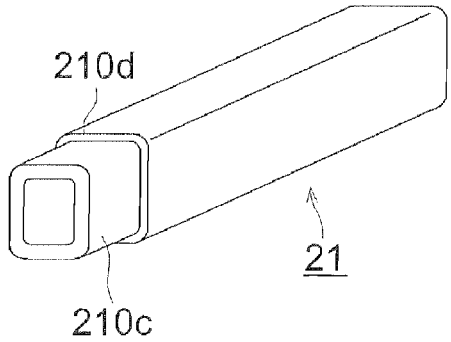
FIG. 7(*a*) is a schematic view showing one example of a fixed electrode.
Figure 7:
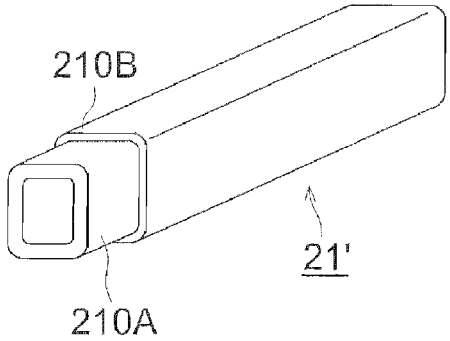

FIG. 7(*a*) and FIG. 7(*b*) each are a pair of schematic views showing one example of the fixed electrode.

In FIG. 7(*a*), square columnar or square cylindrical fixed electrode 21 is structured, similarly to above roll electrode 20, in such a manner that a ceramic material is sprayed on conductive base material 210*c* such as metal, and then ceramic-coated dielectric material 200*d*, sealing-treated with an inorganic material, is coated thereon. Further, as shown in FIG. 7(*b*), square columnar or square cylindrical roll electrode 21' may be structured in such a manner that lining-treated dielectric material 210B, prepared via lining of an inorganic material, is coated on conductive base material 210A such as metal.

Of the processes in a production method of the intermediate transfer member, one example of the film formation process depositing and forming an inorganic compound layer on support 175 will now be described with reference to FIGS. 3 and 5.

In FIGS. 3 and 5, support 175 is stretched around roll electrode 20 and driven roller 201. A predetermined tension is applied to support 175 via actuation of tension providing member 202, and then roll electrode 20 is rotation-driven at a predetermined revolution speed.

Mixed gas G is produced from mixed gas supply unit 24 and then released into discharge space 23.

A voltage of frequency ω1, which is output from first power supply 25, is applied to fixed electrode 21 and a voltage of frequency ω2, which is output from second power supply 26, is applied to roll electrode 20 to generate electric field V wherein frequencies ω1 and ω2 are superimposed in discharge space 23 via these voltages.

Mixed gas G released into discharge space 23 by electric field V is excited into a plasma state. Then, the surface of the support is exposed to mixed gas G in the plasma state, and a film structured of at least one layer selected from an inorganic oxide layer, an inorganic nitride layer, and an inorganic carbide layer, that is, first inorganic compound layer 176 is formed on support 175.

Second inorganic compound layer 177 can similarly be arranged on the thus-formed first inorganic compound layer.

The discharge gas is a gas which is plasma-excited under the above conditions, including nitrogen, argon, helium, neon, krypton, xenon, and a mixture thereof.

The raw material gas is one which contains a component functioning to form a thin film, including, for example, an organic metal compound and an organic compound.

Examples of a silicon compound include, silane, tetramethoxysilane, tetraethoxysilane (TEOS), tetra n-propoxysilane, tetraisopropoxysilane, tetra n-butoxysilane, tetra t-butoxysilane, dimethyldimethoxysilane, dimethyldiethoxysilane, diethyldimethoxysilane, diphenyldimethoxysilane, methyltriethoxysilane, ethyltrimethoxysilane, phenyltriethoxysilane, (3,3,3-trifluoropropyl)trimethoxysilane, hexamethyldisiloxane, bis(dimethylamino)dimethylsilane, bis(dimethylamino)methylvinylsilane, bis(ethylamino)dimethylsilane, N, O-bis(trimethylsilyl)acetamide, bis(trimethylsilyl)carbodiimide, diethylaminotrimethylsilane, dimethylaminodimethylsilane, dihexamethyldisilazane, hexamethylcyclotrisilazane, heptamethyldisilazane, nonamethyltrisilazane, octamethylcyclotetrasilazane, tetrakisdimethylaminosilane, tetraisocyanatesilane, tetramethyldisilazane, tris(dimethylamino)silane, triethoxyfluorosilane, allyldimethylsilane, allyltrimethylsilane, benzyltrimethylsilane, bis(trimethylsilyl)acetylene, 1,4-bistrimethylsilyl-1,3-butadiyne, di-t-butylsilane, 1,3-disilabutane, bis(trimethylsilyl)methane, cyclopentadienyltrimethylsilane, phenyldimethylsilane, phenyltrimethylsilane, propargyltrimethylsilane, tetramethylsilane, trimethylsilylacetylene, 1 (trimethylsilyl)-1-propyne, tris(trimethylsilyl)methane, tris(trimethylsilyl)silane, vinyltrimethylsilane, hexamethyldisilane, octamethylcyclotetrasiloxane, tetramethylcyclotetrasiloxane, hexamethylcyclotetrasiloxane, and M SILICATE 51. However, the present invention is not limited thereto.

Examples of a titanium compound include, but are not limited to, an organic metal compound such as tetradimethylaminotitanium, a metal hydrogen compound of monotitanium or dititanium, a metal halide compound such as titanium dichloride, titanium trichloride, or titanium tetrachloride; a metal alkoxide such as tetraethoxytitanium, tetraisopropoxytitanium, or tetrabutoxytitanium.

Examples of an aluminum compound include, but are not limited to, aluminum n-butoxide, aluminum s-butoxide, aluminum t-butoxide, aluminum diisopropoxide ethylacetoacetate, aluminum ethoxide, aluminum hexafluoropentanedionate, aluminum isopropoxide, aluminum III 2,4-pentanedionate, dimethylaluminum chloride.

Examples of a zinc compound include, but are not limited to, zinc (bis(trimethylsilyl)amide), zinc 2,4-pantanedionate, and zinc 2,2,6,6-tetramethyl-3,5-heptanedionate.

Examples of a zirconium compound include, but are not limited to, zirconium t-butoxide, zirconium diisopropoxide-bis (2,2,6,6-tetramethyl-3,5-heptanedionate), zirconium ethoxy, zirconium hexafluoropentanedionate, zirconium isopropoxide, zirconium 2-methyl-2-butoxide, and zirconium trifluoropentanedianate.

Further, these raw materials may be used individually or in combinations of at least two types of components, provided that an inorganic compound layer containing carbon of the above content is formed therewith.

Via the above method, an intermediate transfer member, exhibiting high transferability, cleaning properties, and durability, which incorporates at least two inorganic compound layers on the surface of the support, can be provided, wherein a first inorganic compound layer and a second inorganic compound layer, containing carbon whose content is less than that in the first inorganic compound layer, are arranged in this sequential order.

The carbon contents in these inorganic compound layers can be adjusted via the amounts of a raw material gas and a gas which controls decomposition of the raw material gas, as well as by setting appropriate conditions for a plasma, discharge apparatus.

The carbon content in first inorganic compound layer 176 thus formed on support 175 can be measured via an XPS method.

Subsequently, via the same method as for first inorganic compound layer 176, second inorganic compound layer 177, containing carbon whose content was adjusted to a predetermined one, is formed on the first inorganic compound layer.

The carbon content in first inorganic compound layer 176 of the present invention is preferably from 0.1% by atom-50% by atom (based on XPS measurement).

It is preferable that second inorganic compound layer 177 contains no carbon or the carbon content thereof is less than that in the first inorganic compound layer. Specifically, the carbon content in the second inorganic compound layer is more preferably at most 20% by atom (based on XPS measurement).

Even in cases in which intermediate transfer member 170 incorporates, as the surface layer, the second inorganic compound layer containing no carbon atoms or containing a smaller amount thereof, intermediate transfer member 170, being free from cracks or peel-off of the film, as well as exhibiting excellent toner releasability even in heavy use, can be prepared via such a structure that the first inorganic compound layer, containing carbon whose content is more than that in the second inorganic compound layer, is formed between the support and the second inorganic compound layer.

EXAMPLES

The present invention will now be specifically described with reference to the following examples that by no means limit the embodiments of the present invention.

1. Preparation of Samples

| (Preparation of a Support)<br>The support was prepared as follows. | |
|---|---|
| Polyphenylene sulfide resin (E2180, produced by Toray Industries, Inc.) | 100 parts |
| Conductive filler (Furnace #3030B, produced by Mitsubishi Chemical Corp.) | 16 parts |
| Graft copolymer (MODIPER A4400, produced by NOF Corp.) | 1 part |
| Lubricant (calcium montanate) | 0.2 part |

The above materials were charged in a single axis extruder, followed by being melt-kneaded to give a resin mixture. A circular dice having a slit-like and seamless belt-shaped discharge outlet is attached to the tip of the single axis extruder, and the kneaded resin mixture was extruded into the seamless belt shape. The extruded seamless belt-shaped resin mixture was taken out to a cylindrical cooling cylinder arranged at the front of the discharge outlet, followed by being cooled and solidified to give a seamless cylinder-shaped intermediate transfer member. The thickness of thus-prepared support was 120 μm.

(Preparation of Inorganic Compound Layers)

A first inorganic compound layer of 100 nm was formed on thus-prepared support using the intermediate transfer member production apparatus employing a plasma CVD method shown in FIG. 3. Further, a second inorganic compound layer of 300 nm was formed thereon. In this case, each electrode in the intermediate transfer member production apparatus employing a plasma CVD method was coated with a dielectric material, wherein each of the opposing electrodes was coated therewith at an one-side wall thickness of 1 mm. The electrode space was set to 1 mm. Further, a metal base material, coated with the dielectric material, was of a stainless jacket specification having a cooling function using cooling water, and discharge was conducted while controlling the electrode temperature with the cooling water. As the power supply used herein, a high frequency power supply (50 kHz) (produced by Sinko Electric Co., Ltd.) and a high frequency power supply (13.56 MHz) (produced by Pearl Kogyo Co., Ltd.) were employed.

Samples 1-8, 11-14, and 16-19 were prepared under the discharge gas conditions, raw material decomposition-controlling gas conditions, raw material gas conditions, high frequency power supply output conditions (power of low frequency-side power supply and power of high frequency-side power supply) as shown in Tables 1 and 2.

Further, Sample 15 was prepared using a commercially available vacuum evaporation apparatus by forming a first inorganic compound layer of 100 nm on a support and then by forming a second inorganic compound layer of 300 nm thereon, wherein the contents of carbon atoms therein were adjusted to the corresponding ones shown in Table 2 by supplying gases containing carbon atoms.

Still further, as comparative examples, Samples 9 and 10 were prepared in the same manner as for the above examples except for the conditions shown in Tables 1 and 2.

2. Measurement of the Carbon Content

In composition analysis via XPS measurement, measurement was carried out using an X-ray photoelectron spectrometer (ESCALAB 200R, produced by VG Scientific, Ltd.).

3. Evaluation Methods (1) Transfer Efficiency

As a printer, magicolor 2200 (produced by Konica Minolta Business Technologies, Inc.) was used. Toner transferability during a primary and a secondary transfer was evaluated as transfer efficiency, wherein a two color-superimposed solid image was printed using a polymerized toner of an average particle diameter of 6.5 μm. The primary transfer efficiency refers to a ratio of the weight of a toner image transferred to the intermediate transfer member to the weight of the toner image formed on the photoreceptor. The second transfer efficiency refers to a ratio of the weight of the toner image transferred to recording paper to the weight of the toner image formed on the intermediate transfer member.

A: Both the primary transfer efficiency and the secondary transfer efficiency were 90% or more.

B: One of the primary transfer efficiency and the secondary transfer efficiency was 90% or more, but the other was less than 90%.

C: Both the primary transfer efficiency and the secondary transfer efficiency were less than 90%.

(2) Cleaning Properties

Using the above printer, the surface state of the intermediate transfer member was visually observed after the intermediate transfer member surface had been cleaned with a cleaning blade to examine the adhesion state of the toner, being ranked as "A" for the state where no toner adhesion was noted, "B" for the state where a slight amount thereof was noted, meaning no practical problem, and "C" for the state being practically problematic.

(2) Durability Test

Using the above printer, a full color image was printed at a print speed of 5 sheets/minute, and then the number of full color sheets, having been printed until the belt broke down, was measured.

A: No cracks of the surface or film peel-off occurred even after the model had exceeded its machine life.

B: Cracks of the surface or film peel-off occurred on printing when 70% of the machine life of the model had been reached, or thereafter.

C: Cracks of the surface or film peel-off occurred on printing before 70% of the machine life of the model was reached.

The measurement results and evaluation results of Samples 1-19 are shown in Table 2.

TABLE 1

| | Discharge gas | | Raw material decomposition-controlling gas | | Raw material gas | | High frequency power supply output condition | |
|---|---|---|---|---|---|---|---|---|
| | Type | *1 | Type | *1 | Type | *1 | Low frequency side | High frequency side |
| Titanium oxide layer | Nitrogen | 97.9 | Hydrogen | 2.0 | Tetraisopropoxytitanium | 0.1 | 4.5 kV/cm | Shown in Table 2 |
| Silicon oxide layer | | 89.9 | Oxygen | 10.0 | Tetraethoxysilane | 0.1 | | |
| Aluminum oxide layer | | 99.5 | Oxygen | 0.4 | Aluminum t-butoxide | 0.1 | | |
| Zinc oxide layer | | 97.9 | Hydrogen | 2.0 | Zinc 2,2,6,6-tetramethyl-3,5-heptanedionate | 0.1 | | |
| Zirconium oxide layer | | 99.5 | Oxygen | 0.4 | Zirconium t-butoxide | 0.1 | | |

*1: Volume (% by volume)

TABLE 2

| Film formation method | Sample | First inorganic compound layer Material | *1 | Carbon content (% by atom) | Second inorganic compound layer Material | *1 | Carbon content (% by atom) | Transfer efficiency | *2 | Durability | Overall evaluation | |
|---|---|---|---|---|---|---|---|---|---|---|---|---|
| Plasma CVD | 1 | $TiO_2$ | 3.0 | 25.0 | $SiO_2$ | 6.0 | 0.5 | A | A | A | A | Inv. |
| Plasma CVD | 2 | $TiO_2$ | 3.0 | 25.0 | $SiO_2$ | 4.5 | 5.0 | A | A | A | A | Inv. |
| Plasma CVD | 3 | $TiO_2$ | 3.0 | 25.0 | $SiO_2$ | 2.5 | 20.0 | A | A | A | A | Inv. |
| Plasma CVD | 4 | $TiO_2$ | 3.0 | 25.0 | $SiO_2$ | 2.0 | 21.0 | B | B | B | B | Inv. |
| Plasma CVD | 5 | $TiO_2$ | 2.5 | 30.0 | $SiO_2$ | 6.0 | 0.5 | A | A | A | A | Inv. |
| Plasma CVD | 6 | $TiO_2$ | 1.2 | 50.0 | $SiO_2$ | 6.0 | 0.5 | A | A | A | A | Inv. |
| Plasma CVD | 7 | $TiO_2$ | 1.0 | 51.0 | $SiO_2$ | 6.0 | 0.5 | A | B | B | B | Inv. |
| Plasma CVD | 8 | $TiO_2$ | 7.0 | 1.0 | $SiO_2$ | 6.0 | 0.5 | A | A | A | A | Inv. |
| Plasma CVD | 9 | $TiO_2$ | 3.0 | 25.0 | $SiO_2$ | 1.5 | 30.0 | B | B | C | C | Comp. |
| Plasma CVD | 10 | $TiO_2$ | 7.0 | 1.0 | $SiO_2$ | 5.5 | 1.0 | A | A | C | C | Comp. |
| Plasma CVD | 11 | $SiO_2$ | 3.5 | 10.0 | $SiO_2$ | 6.0 | 0.5 | A | A | A | A | Inv. |
| Plasma CVD | 12 | $TiO_2$ | 3.0 | 25.0 | $Al_2O_3$ | 4.0 | 5.0 | A | A | A | A | Inv. |
| Plasma CVD | 13 | $TiO_2$ | 3.0 | 25.0 | $ZrO_2$ | 4.5 | 5.0 | A | A | A | A | Inv. |
| Plasma CVD | 14 | ZnO | 3.5 | 10.0 | $SiO_2$ | 6.0 | 0.5 | A | A | A | A | Inv. |
| Vacuum evaporation | 15 | $TiO_2$ | — | 1.0 | $SiO_2$ | — | 0.5 | A | A | B | B | Inv. |
| Plasma CVD | 16 | $TiO_2$ | 7.0 | 1.0 | $SiO_2$ | 6.0 | 0.5 | A | A | A | A | Inv. |
| Plasma CVD | 17 | $SiO_2$ | 8.0 | 0.1 | $SiO_2$ | 9.0 | 0.0 | A | A | B | B | Inv. |
| Plasma CVD | 18 | $SiO_2$ | 3.5 | 10.0 | $Si_3N_4$ | 5.0 | 5.0 | A | A | A | A | Inv. |
| Plasma CVD | 19 | $TiO_2$ | 3.0 | 25.0 | $SiO_2/Al_2O_3$ = 3/1 | 4.0 | 5.5 | A | A | A | A | Inv. |

*1: High frequency side power density ($W/cm^2$), Comp.: Comparative example

*2: Cleaning properties

The above results show that an intermediate transfer member, exhibiting excellent toner releasability and enhanced transfer efficiency, which is free from cracks even in long-time heavy use, as well as an image forming apparatus employing the intermediate transfer member have been realized employing the intermediate transfer member incorporating a first inorganic compound layer containing carbon atoms formed on the support and a second inorganic compound layer, as the surface layer, containing no carbon atoms or containing carbon atoms whose content is less than that in the first inorganic compound layer.

Further, it is shown that, by allowing the carbon content in the second inorganic layer to be 20% by atom or less (based on XPS measurement), the intermediate transfer member, exhibiting further enhanced transfer efficiency and cleaning properties, can be realized.

Still further, it is shown that, by allowing the carbon content in the first inorganic layer to be from 0.1% by atom to 50% by atom (based on XPS measurement), the intermediate transfer member, exhibiting further enhanced durability, can be realized.

What is claimed is:

1. An intermediate transfer member comprising a support having thereon a first inorganic compound layer comprising carbon atoms and, as a surface layer, a second inorganic compound layer containing no carbon atoms or containing carbon atoms of which carbon content is less than a carbon content in the first inorganic compound layer.

2. The intermediate transfer member of claim 1, wherein the carbon content in the first inorganic compound layer is 0.1% by atom to 50% by atom (based on an XPS measurement).

3. The intermediate transfer member of claim 1, wherein the carbon content in the second inorganic compound layer is 20% by atom or less (based on an XPS measurement).

4. The intermediate transfer member of claim 1, wherein the first inorganic compound layer or the second inorganic compound layer comprises a compound comprising at least one element selected from Si, Ti, Al, Zr, and Zn.

5. The intermediate transfer member of claim 1, wherein the first inorganic compound layer and the second inorganic compound layer each comprise a compound comprising at least one element selected from Si Ti, Al, Zr, and Zn.

6. The intermediate transfer member of claim 1, wherein the first inorganic compound layer or the second inorganic compound layer is an inorganic oxide layer.

7. The intermediate transfer member of claim 1, wherein the first inorganic compound layer and the second inorganic compound layer each are an inorganic oxide layer.

8. A method of producing the intermediate transfer member of claim 1, wherein at least one of the first inorganic compound layer and the second inorganic compound layer is formed via an atmospheric pressure plasma CVD method.

9. An image forming apparatus provided with an intermediate transfer member which further transfers a toner image transferred from a surface of an image carrier to a recording medium, wherein the intermediate transfer member is the intermediate transfer member of claim 1.

* * * * *